United States Patent [19]

Short et al.

[11] Patent Number: 4,522,696

[45] Date of Patent: Jun. 11, 1985

[54] CARRIER FOR MATERIAL DURING ELECTROLYTIC FINISHING

[75] Inventors: Edward P. Short, Addisbury; Gerald Bernardo, Banbury, both of England

[73] Assignee: Alcan International Limited, Montreal, Canada

[21] Appl. No.: 483,121

[22] Filed: Apr. 8, 1983

[30] Foreign Application Priority Data

Apr. 14, 1982 [GB] United Kingdom ..... 8210858

[51] Int. Cl.[3] ..... C25D 17/04

[52] U.S. Cl. ..... 204/297 W

[58] Field of Search ..... 204/297 W; 269/250, 269/254 R; 248/221.3, 221.4, 121

[56] References Cited

U.S. PATENT DOCUMENTS 3,282,824 11/1966 Creese ..... 204/297 W 3,334,413 8/1967 Smith ..... 204/297 W X

FOREIGN PATENT DOCUMENTS 1115265 5/1968 United Kingdom ..... 204/297 W

*Primary Examiner*—John F. Niebling

*Attorney, Agent, or Firm*—Cooper, Dunham, Clark, Griffin & Moran

[57] ABSTRACT

A carrier for supporting extended metal workpieces during electrolytic finishing treatments comprises a flight bar supporting at least two dependent spline members, both the flight bar and the spline members being electrically connected to the workpieces supported by the carrier. Each spline has two or more support arms for the workpieces and a clamp bar, carrying spaced clamp arms arranged at the same vertical interval as the support arms, is arranged for vertical movement in relation to each spline and is employed to clamp the workpiece in electrical contact with the upper or lower side of the adjacent support arm.

5 Claims, 6 Drawing Figures

CARRIER FOR MATERIAL DURING ELECTROLYTIC FINISHING

Figure 1:
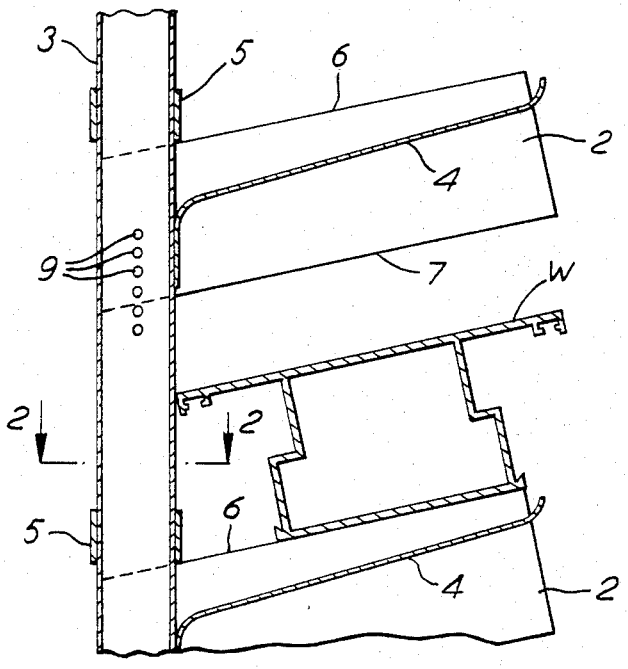

The present invention relates to apparatus for supporting extended lengths of metal during electrolytic finishing treatments. The apparatus of the invention is primarily intended for supporting extruded aluminium sections during anodising, but it is equally applicable to the support of lengths of metal in electrolytic colouring processing and electrophoretic painting processes.

In all electrolytic processes of this nature it is essential to support the workpiece to be treated so that it forms one electrode of an electric circuit. In order for the workpiece to perform this function it must be secured to a carrier in such a way as to ensure a good electrical connection. This usually involves manually clamping the workpiece to the carrier and this is a labour-intensive operation.

In one known form of carrier employed in anodising lengths of extruded aluminium sections the carrier comprises an overhead horizontal member, usually known as the flight bar, and vertical member, usually referred to as splines, which are suspended from the flight bar and are electrically connected to the ends of the extruded sections. The two splines carry horizontal arms onto which the workpieces are loaded by hand and then secured thereto by clamps.

The flight bar and the spline constitute the electrical conductors for the whole current throughput of the cell and for economy in the use of electrical energy and to keep down the weight load imposed on the overhead structure from which the carrier is supported the flight bar and the splines are constructed of aluminium; in some instances the aluminium splines are provided with a thin layer of material which is conductive but substantially unaffected by the cell electrolyte. In conventional D.C. sulphuric acid anodising it is known to provide a titanium surface layer on the splines. The titanium layer forms a very thin barrier-layer type anodic film under D.D. anodising conditions, so that it does not act as a thief of the anodising current. The thus formed anodic layer on the titanium is so thin and friable that it breaks under the pressure applied when clamping an aluminium workpiece to it. In consequence it is unnecessary to apply an oxide stripping step between successive anodising steps.

It is also well known to use uncoated aluminium splines from which the oxide coating is chemically or mechanically stripped after each anodising cycle to remove the aluminium oxide coating since the presence of such an oxide coating adversely affects the contact between an arm and the workpiece supported by it.

In the present invention the spline may be constructed from bare aluminium or from aluminium provided with a protective and conductive coating of the character discussed above.

According to the present invention there is provided a carrier for supporting extended lengths of metal during electrolytic finishing treatments comprising a flight bar, supporting two or more dependent spline members characterised in that each spline member carries at least one series of vertically spaced support arms in electrical connection with it and is provided with a vertically slideable clamp bar, carrying a series of vertically spaced clamp members arranged at substantially the same interval as the support arms on the spline. Vertical movement of the clamp bars brings the clamp members into clamping engagement with a workpiece supported on an adjacent support arm. Each clamp member, which is very preferably a spring member, may be substantially level with a support arm when in the unclamped position and be movable upward to bring each workpiece into clamping engagement with a surface on the underside of the support arm immediately above it. Alternatively the clamp bar may be moved downwardly to clamp all the workpieces simultaneously to the respective support arms. The individual clamp members are preferably made of heavy guage spring strip or rod in order to allow for some unevenness in spacing and/or in the thickness of the workpiece. The spring strip or rod is preferably made of or coated with titanium or other relatively incorrodible metal. Since the spring is not required to act as a current conductor, it is immaterial whether it forms an oxide coating.

Each support arm may consist of a pair of horizontally spaced pieces of sheet metal and the clamp bar slides vertically in relation to the spline to move the clamp members from an unclamped position to a clamping position in which they press the workpiece into electrical contact with the top surface of the support arm on which it rests or with the underside of the next support arm. As an alternative to the above the support arm may consist of a single part and the clamp members be in the form of a pair of horizontally spaced parts. As a further alternative the clamp bar may be housed within the spline and provided with protruding spring clamp members free to travel vertically between the locations of adjacent support arms.

The upper surface of the support arms preferably slope downwardly from their free ends to their point of attachment to the spline for ease of loading and to avoid displacement during the clamping operation. Where clamping is against the undersurface of the support arms, that surface is also preferably somewhat inclined in the same sense, as are also the clamp members in their unstressed condition.

It is possible, although not preferred, for the support arms to be made from spring material as an alternative to or in addition to the clamp members.

The clamp bar is preferably lockable in any one of a series of raised positions or is movable by a screw jack or similar device so that the carrier may be employed for the treatment of workpieces in a variety of thicknesses (in the vertical direction). The movement of the clamp bar is preferably effected by means of a stationary drive element, located at the loading station for the carrier and the clamp bar is locked in position to maintain the electrical contact between the workpieces and the support arms while the carrier is progresses through the stages of the anodising (or other electrolytic) process.

Referring now to the accompanying drawings

Figure 2:
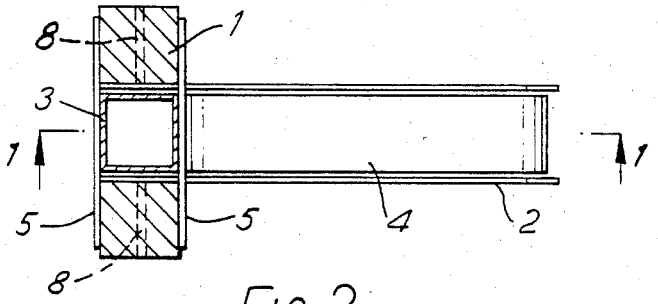
Figure 3:
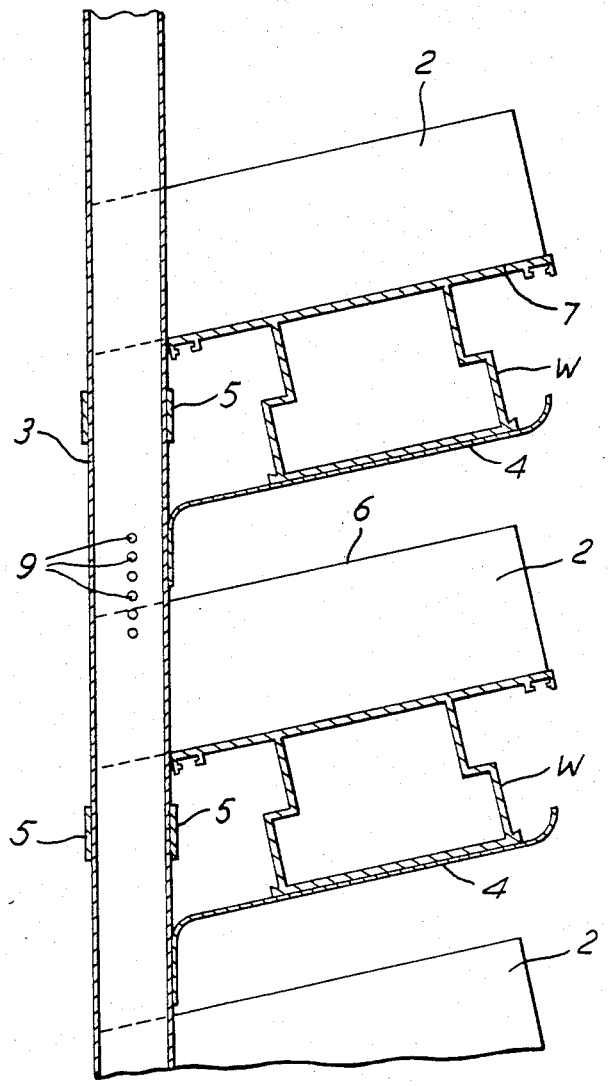
Figure 4:
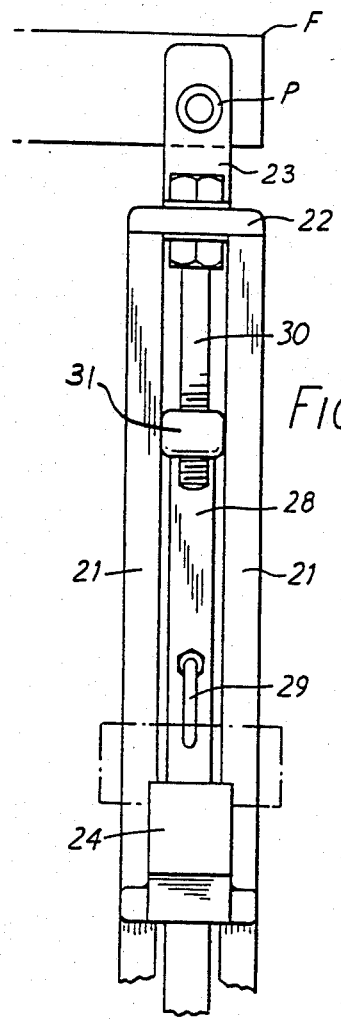
Figure 5:
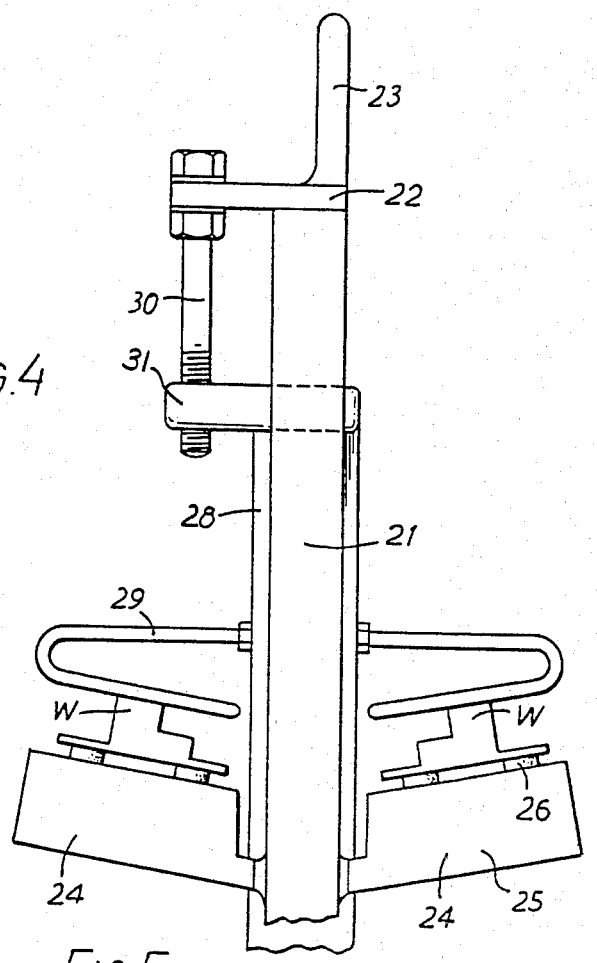
Figure 6:
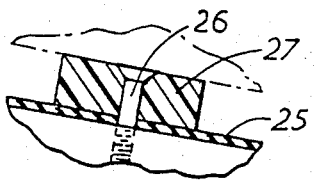

FIG. 1 is a vertical section of a spline of one form of carrier constructed in accordance with the invention on line 1—1 of FIG. 2 with the clamp bar in the loaded position, FIG. 2 is a horizontal section on line 2—2 of FIG. 1, FIG. 3 is a view similar to FIG. 1 with the clamp bar in the clamped position, FIG. 4 is a front view of an alternative form of spline for a carrier, FIG. 5 is a corresponding side view and FIG. 6 is a detail of the contact arrangement.

The carrier comprises a horizontal beam (not shown) which acts as the flight bar and which supports a pair of spaced splines. Each spline comprises a pair of spaced, square-section aluminium bars 1, which are preferably provided with a titanium surface layer.

The bars 1 are the current conductors from the flight bars to the workpieces, which are supported by the support arms 2.

Each support arm 2 comprises a pair of parallel titanium plates, welded to the vertical spline bars 1.

A square section tube 3 is guided between the spline bars 1 to act as clamp bar. It is provided with any suitable protective coating, which may be titanium or may be non-conductive since the clamp bar is not a current conductor.

The clamp bar tube 3 carries a series of spring strip clamp members 4 which are at the same vertical interval as the support arms 2. The tube 3 carries one or more pairs of guide arms 5, which rest on the support arms 2 when the carrier is in the loading position shown in FIG. 1, in which the spring clamp members 4 are nested within the respective support arms 2.

In FIG. 1 a typical extruded-section workpiece W is shown loaded onto the inclined top surface 6 of the support arms 2. By lifting the clamp bar 3 the workpieces W are carried up by the clamp members 4 and held against the inclined under surface 7 of the upwardly adjacent support arm 2 as shown in FIG. 3. The clamp bar is then held in this raised position by passing a pin through an aperture 8 in the bars 1 and one of a series of apertures 9 in the clamp bar tube 3. This allows the carrier to be employed with a wide range of workpieces of different thickness. The spring clamp members 4 hold the workpiece securely clamped to the under surface 7 of the co-operating support arm.

In the illustrated construction the support arms extend on only one side of the spline formed by bars 1. They may extend on both sides of the spline, either in line with each other or in staggered positions.

The carrier of the present invention can be seen to be very convenient for loading either by hand or by an automatic loading system.

The raising of the clamping bar to clamp the workpieces in to the support arms may be effected by hydraulic jacks or the like. The clamp bars may be both attached to a common beam and the raising of the clamp bars may be effected by an overhead crane, such as is employed for lifting the carrier into and out of a treatment bath.

The carrier illustrated may be varied in a number of details. Thus the clamp bar may be arranged to move downwardly to clamp each workpiece W against the upper surface of support arm 2, on which it rests. For that purpose means may be located at the carrier loading station for applying an appropriate downward load to the clamp bar, which is then locked in relation to the spline by an appropriate means, for example by means of pins in the apertures 8, 9 of FIG. 1. In such alternative arrangement the clamp spring are preferably arranged in a downward-facing position.

The apertures 9 and corresponding apertures are preferably located at a level above the cell electrolyte level and will thus lie near the point at the top end of the spline (not as indicated in FIGS. 1 and 3).

The clamp member 3 may extend somewhat below the spline bars 1 in the clamped position and it may be either spring-loaded or weigh-loaded to apply clamping pressure. The carrier may then be automatically unclamped by allowing it to rest upon the ends of the clamp bars, when the weight of the carrier and its load of workpieces produces the unclamping force.

Where the carrier is to be employed in an alternating current process, such as electrolytic colouring or a.c. anodising, the support arms are formed in aluminium, because a stable anodic axide coating cannot be formed on titanium in such circumstances. In such event it is necessary to subject the support arms 2 to a mechanical or chemical oxide stripping treatment after each electrolytic treatment stage.

In the alternative construction illustrated in FIGS. 4–6 the spline comprises vertical rectangular section aluminium bars 21, which are connected by a jack-mounting plate 22 at their top ends and a hanger 23, by which the spline is suspended from the flight bar F by means of pin P. Support arms 24 are welded or bolted to the bars 21 and are also formed of aluminium.

The assembly formed by the members 21, 22, 23 and 24 are dipped in a non-conductive plastics material so as to enrobe it completely in a non-conductive skin 25.

The skin 25 is pierced in the upper surface of each arm 24, by two or more aluminium contact pins 26, which are threaded into the arms. Each pin 26 is preferably surrounded by an axially-compressible, non-conductive sleeve 27, made of a suitable plastic material.

Since the workpiece W is clamped down against its arm before immersion in electrolyte, the sleeves 27, when provided, seal off the faces of the contact pins 26 from contact with the electrolyte and so long as the pins are kept out of contact with the electrolyte during an electrolytic treatment, they will remain free of anodic oxide and no oxide stripping operation will be required.

A rectangular clamp bar 28 is slideably arranged between the members 21 and carries U-shaped clamp members 29 formed of spring rod.

The clamp bar is movable upwards and downwards by means of a jack screw 30, trapped in the jack-mounting plate 22, its lower end being threaded into a lug 31 at the top end of the clamp bar 28.

It will readily be seen that, to permit loading of the jig, the spring clamp members 29 are raised to a height sufficient to permit workpieces to be loaded onto the arms. The spring clamp members 29 are then moved downward by the clamp bar 28 to clamp the work against the contact pins 26 and their surrounding sleeves. The load of work is then ready to be lifted into the treatment tank.

To avoid excessive corrosion by chemical (not electrolytic) attack, the clamp bar 28 is preferably formed of aluminium, with a protective titanium coating and the clamp members 29 are formed of titanium rod.

We claim:

1. A carrier for supporting extended lengths of metal during electrolytic finishing treatments comprising a flight bar supporting at least two dependent spline members, each spline member carrying at least one series of vertically spaced support arms in electrical connection with it and having an associated vertically slideable clamp bar, carrying a series of vertically spaced spring clamp members arranged at substantially the same interval as the support arms on the spline and each arranged for clamping a workpiece in electrical contact with a surface on an adjacent support arm.

2. A carrier as clamped in claim 1 in which each spline member is formed of a pair of spaced vertical bar-like metal members, vertically spaced support arms interconnecting such bar-like metal members, said clamp arm being arranged for vertical sliding movement between said bar-like members, said clamp arm carrying spring clamp members projecting laterally from between said bar-like members and each positioned over an associated support arm, each clamp member being arranged for movement in a vertical direction in relation to its associated support arm.

3. A carrier as claimed in claim 2 further including jack means connected between the spline member and its associated clamp member and arranged to effect vertical movement of said clamp member relative to said spline member.

4. A carrier as claimed in claim 2 in which each spline member and its associated support arms are encased in a non-conductive plastic coating, each support arm being provided with at least one exposed metallic contact on the upper face thereof, each contact being electrically connected with said spline member.

5. A carrier according to claim 4 in which each metallic contact is surrounded by an axially compressible sleeve, arranged to seal off the exposed face of said contact from access to liquid when said sleeve is subjected to compression between said support arm and a workpiece supported thereby.

* * * * *